US005559532A

United States Patent [19]

Gardyne

[11] Patent Number: 5,559,532

[45] Date of Patent: Sep. 24, 1996

[54] METHOD AND APPARATUS FOR PARALLEL PIXEL HARDWARE CURSOR

[75] Inventor: Robert P. Gardyne, Oakland, Calif.

[73] Assignee: LSI Logic, Inc., Milpitas, Calif.

[21] Appl. No.: 337,264

[22] Filed: Nov. 10, 1994

[51] Int. Cl.[6] ..... G09G 5/08

[52] U.S. Cl. ..... 345/145

[58] Field of Search ..... 345/145, 157, 345/199

[56] References Cited

U.S. PATENT DOCUMENTS

| | | | |
|---|---|---|---|
| 5,146,211 | 9/1992 | Adams et al. | 345/145 |
| 5,196,834 | 3/1994 | Edelson et al. | 345/199 |
| 5,359,347 | 10/1994 | Kim et al. | 345/145 |
| 5,361,081 | 11/1994 | Barnaby | 345/145 |

*Primary Examiner*—Jeffery Brier
*Attorney, Agent, or Firm*—Albert C. Smith; Edward B. Weller

[57] ABSTRACT

A display system displays a cursor on a monitor using parallel pixels of video data. A hardware cursor processor receives a sequence of clock signals, cursor data, parallel video data arranged in P logical pixels per clock signal, and cursor position data. The hardware cursor processor provides composite video data representative of the cursor data and the video data to a memory. The composite video data is arranged in P logical pixels per clock signal. The hardware cursor processor arranges the cursor data within the P logical pixels per clock signal in response to the cursor position data. The cursor position data includes a position signal HPOS indicative of the horizontal position of the cursor on the screen and includes a preset signal HPRE indicative of the horizontal offset of the cursor. The cursor data is arranged within the P logical pixels of the composite video data to begin at the logical pixel equal to [(HPOS-HPRE) modulus P].

A memory has an input coupled to the output of the hardware cursor processor and has an output for providing a digital video signal indicative of the video data and the cursor data. A digital-to-analog converter has an input coupled to the output of the memory for receiving the digital video signal and has an output coupled to the monitor for providing an analog signal indicative of the cursor data and the video data. The monitor has an input coupled to the output of the digital-to-analog converter for displaying the video data and the, cursor data in response to the analog signal.

2 Claims, 9 Drawing Sheets

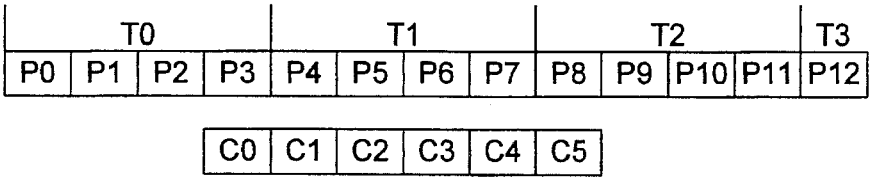
*FIG. 9a*
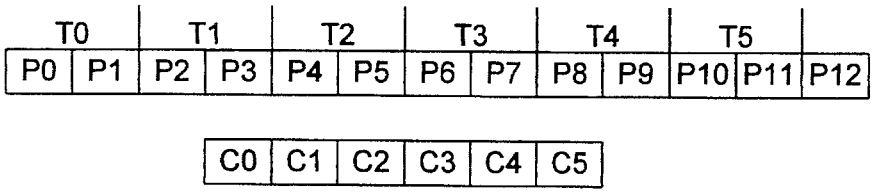
*FIG. 9b*
| ENGINE | T0 | T1 | T2 |
|---|---|---|---|
| 56a - 0 | VIDEO | C1 | C5 |
| 56b - 1 | VIDEO | C2 | VIDEO |
| 56c - 2 | VIDEO | C3 | VIDEO |
| 56d - 3 | C0 | C4 | VIDEO |
*FIG. 10a*
| ENGINE | T0 | T1 | T2 | T3 | T4 | T5 |
|---|---|---|---|---|---|---|
| 56a - 0 | VIDEO | VIDEO | C1 | C3 | C5 | VIDEO |
| 56b - 1 | VIDEO | VIDEO | C1 | C3 | C5 | VIDEO |
| 56c - 2 | VIDEO | C0 | C2 | C4 | VIDEO | VIDEO |
| 56d - 3 | VIDEO | C0 | C2 | C4 | VIDEO | VIDEO |
*FIG. 10b*

METHOD AND APPARATUS FOR PARALLEL PIXEL HARDWARE CURSOR

FIELD OF THE INVENTION

This invention relates to hardware cursors, and more particularly to hardware cursors operating with parallel pixel input.

BACKGROUND OF THE INVENTION

As is known in the art of computers and the like, the cursor is a picture or pattern on a monitor indicating the location on the monitor which is currently active (i.e., the location at which input from a user is accepted). The cursor is typically a two-dimensional picture of a size much smaller than the size of the monitor, and a "hot point" of the cursor, a single picture element (pixel) of the cursor, is the active location. At a current cursor location, the cursor pattern is displayed instead of the video data which belongs to that location. The cursor may be moved in response to keyboard strokes or to movement of a mouse.

Cursors may be implemented either in hardware or in software. A software cursor is implemented using a software program which maintains the cursor pattern in an active video memory and displays the pattern at the appropriate location on the monitor. The software moves the cursor from a first location on the monitor to a second location by first restoring, from a video buffer, the video data which belongs to the first location, by saving the video data of the second location in the video buffer, and by drawing the cursor pattern in the second location.

The software cursor consumes significant amounts of central processing unit (CPU) execution time (CPU overhead), due to the many operations necessary to move the cursor and the many times the cursor typically gets moved. Due to the large number of operations necessary, software cursors are known to jerk and blink.

Hardware cursors are electronic circuits which selectively transform the incoming video data stream, transferring only those parts of the video data stream which correspond to the current location of the cursor pattern. Control bits indicating a two-dimensional cursor pattern are typically stored in non-displayed video memory.

At some point during the display period, often during the horizontal retrace and blanking period, the hardware cursor circuits transfer the pattern bits for one line of cursor pattern to storage cells within a video controller of the computer. The video controller then synchronizes the pattern bits with the incoming video stream and transforms the relevant bits in the video stream in accordance with the pattern bits.

There are several standards for transforming the video stream in accordance with the pattern bits. Among the possible mapping for two-bits of cursor pattern per pixel are the VGA AND/XOR function, the XGA™ sprite color mapping and the X-WINDOWS color mapping, which are each well known in the art.

The hardware cursor overcomes the liability of the CPU overhead associated with the software cursor. However, the performance of hardware cursors is limited because conventional hardware cursors require that only one pixel (of the video stream) be processed at a time. Although many pixels may be transformed at the same time in different pipeline stages of the hardware cursor circuit, at each pipeline stage and on each clock edge, only one pixel is present.

Such serial hardware cursors can only operate at the maximum frequency $F_{max}$ of the clock. To insure the operating speed, it is known in the art to provide an input data stream having multiple pixels supplied concurrently. The hardware cursor circuits receive on concurrent pixel input stream, having X regular pixels per "concurrent pixel," to the maximum frequency $F_{max}$ and produces an output stream with the same format (X regular pixels delivered concurrently, at frequency $F_{max}$). External devices convert the concurrent pixel stream at frequency $F_{max}$ to a one pixel per pixel video stream at frequency X times $F_{max}$.

However, prior art hardware cursors do not successfully transform multiple input pixels per clock as later described herein with reference to FIGS. 1 and 2.

Conventional hardware cursors additionally do not perform correctly when a portion of the cursor pattern is to be displayed, such as might happen when the cursor is located at the border of the display area of the monitor. In the conventional hardware cursors, the pixels outside of the active cursor area are not transformed, while those inside the cursor area are. This may produce a portion of the cursor improperly displayed in the non-active or overscan region of the display.

An analogous problem occurs when a large programmable offset value reduces the displayed cursor pattern width to less than the number of concurrently processed pixels. In this case, only one pixel may need to be transformed by the hardware cursor, but because the minimum granularity for transformation is the number of pixels per clock, all pixels present on that clock are transformed.

SUMMARY OF THE INVENTION

In accordance with the present invention, a display system displays a cursor on a monitor. The display system includes a hardware cursor processor having a first input for receiving a sequence of clock signals. A second input of the hardware cursor processor receives cursor data. A third input of the hardware cursor processor receives parallel video data arranged in P logical pixels per clock signal. A fourth input of the hardware cursor processor receives cursor position data. The hardware cursor processor provides composite video data representative of the cursor data and the video data to an input of a memory. The composite video data is arranged in P logical pixels per clock signal. The cursor data is arranged within the P logical pixels per clock in response to the cursor position data.

The memory has an output coupled to an input of a digital-to-analog converter for providing a digital video signal indicative of the video data and the cursor data. The digital-to-analog converter has an output coupled to an input of a monitor for providing an analog signal indicative of the cursor data and the video data. The monitor displays the video data and the cursor data in response to the analog signal.

BRIEF DESCRIPTION OF THE DRAWINGS

FIG. 9*a* and 9*b* are schematic diagrams illustrating a portion of a video signal and a cursor pattern.

FIG. 10*a* and 10*b* are schematic diagrams illustrating the output cursor control signal indication of each engine of the hardware cursor processor of FIG. 8.

DESCRIPTION OF THE PREFERRED EMBODIMENT

Figure 1:
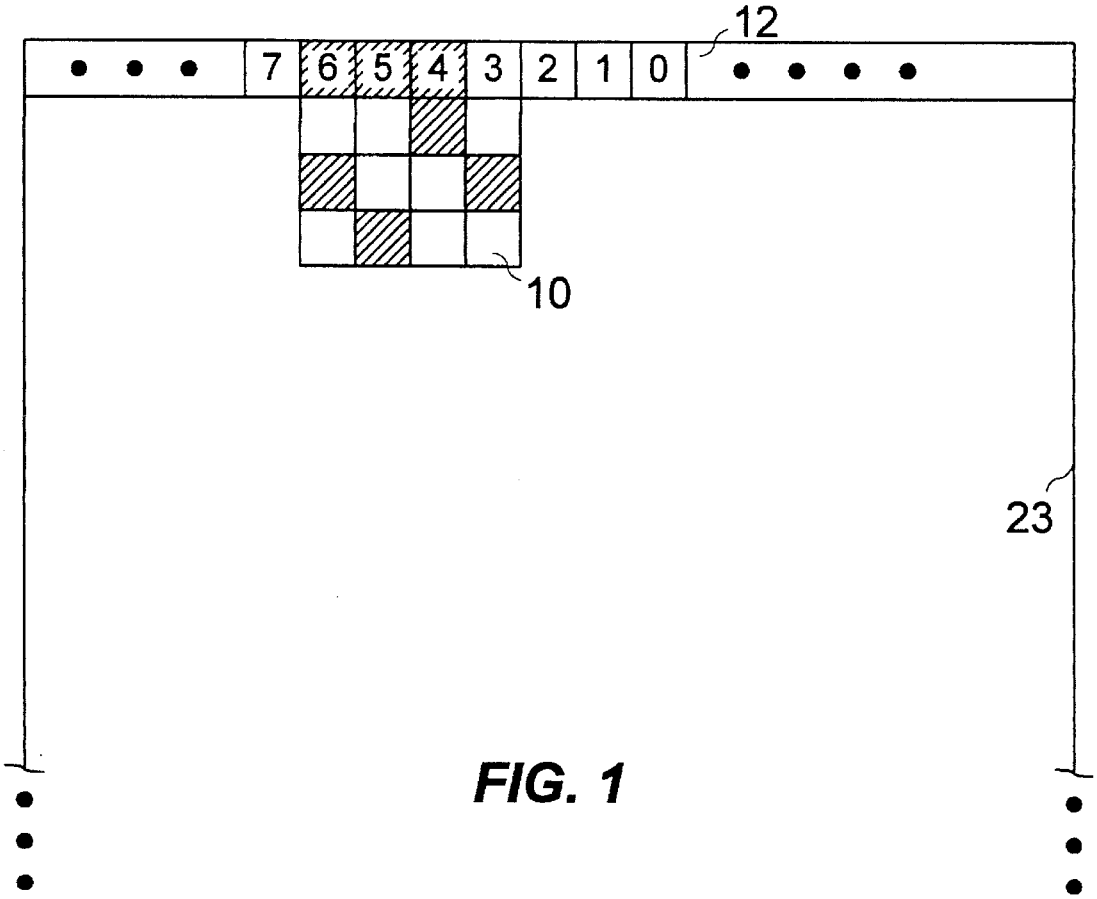
FIG. 1 is a schematic diagram illustrating a portion of a monitor having a cursor displayed thereon.

Referring to FIG. 1, there is illustrated a portion of a monitor 28 having a cursor pattern 10 thereon. The cursor pattern 10 covers a portion of four rows of picture elements (pixels) on the monitor. A row 12 includes pixels 0–7 having three dark pixels 4, 5, 6 and one light pixel 3.

Figure 2:
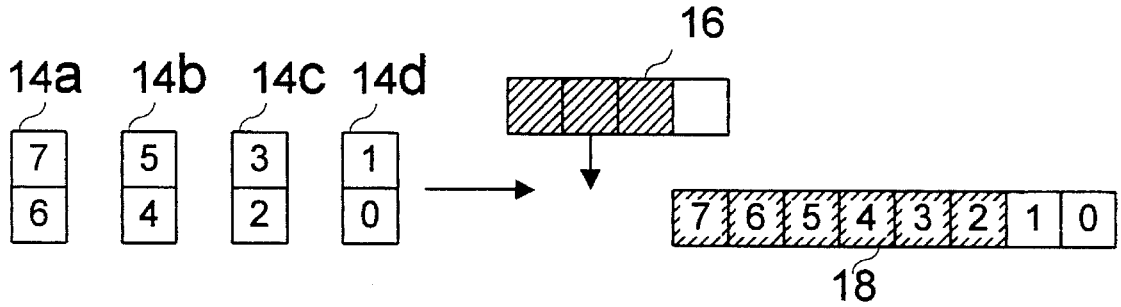
FIG. 2 (PRIOR ART)
FIG. 2 is a schematic diagram illustrating the operation of a conventional hardware cursor on parallel input pixels.

Referring to FIG. 2, there is illustrated the eight pixels of the cursor 10 in row 12 presented as concurrent pixels 14 and the operation of a conventional hardware cursor on the pixels 14. In the example of FIG. 2, each concurrent pixel 14 includes two pixels of row 12. Concurrent pixel 14*a* includes pixels 6 and 7; concurrent pixel 14*b* includes pixels 4 and 5; concurrent pixel 14*c* includes pixels 2 and 3; and concurrent pixel 14*d* includes pixels 0 and 1. In conventional hardware cursors, if the eight pixels of row 12 are transformed by a first row 16 of the cursor pattern, each concurrent pixel 14 is transformed by one set of pattern bits from the cursor pattern. Thus, the conventional hardware cursor produces an output video stream 18 having pixels 2–7 that are dark and pixels 0 and 1 that are light.

The output 18 is incorrect in two respects: 1) too many pixels have become dark and 2) the wrong pixels are transformed. Only pixels 4–6, representing 1½ concurrent pixels 14, should have been transformed, as shown in FIG. 1.

Figure 3:
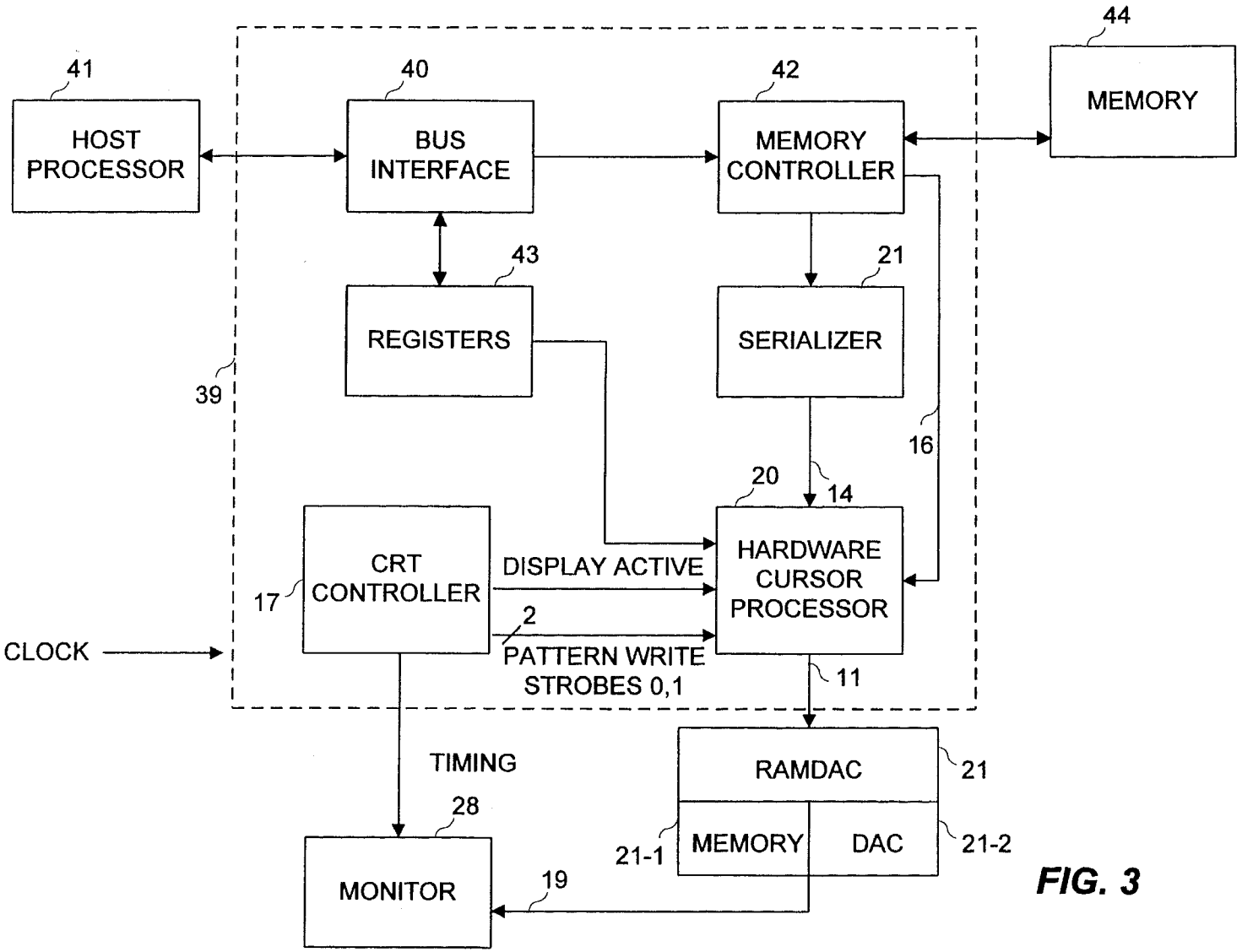
FIG. 3 is a block diagram illustrating of a display system in accordance with one embodiment of the present invention.

Referring to FIG. 3, there is shown a block diagram illustrating a display system in accordance with one embodiment of the present invention. The display system indicates a video controller 39 having a bus interface 40 coupled to a host processor 41 for communicating display data between the video controller 39 and the host processor 41. The video controller 39 may be a conventional video controller, such as a model HT216 manufactured by LSI Logic Corporation of Milpitas, Calif., that is modified to include a hardware cursor processor 20 described later herein. The display data includes the video image and control data. The host processor may be, for example, a model 80286 processor manufactured by Intel Corporation of Santa Clara, Calif. The video controller 39 receives an external clock signal (e.g., 105 megahertz) for controlling the timing of the controller 39.

The bus interface 40 provides the display data to a memory controller 42 and to a plurality of programmable registers 43. The memory controller 42 provides the display data to a memory 44, which stores both the video image and cursor data 16. Alternatively, the memory 44 may be part of the video controller 39. Alternatively, the cursor data 16 may be stored in a separate memory either internal or external to the video controller 39. The memory controller 42 retrieves the video image from the memory 44 and provides such data to a serializer 21 which reformats the data into a monitor format as video data 14. The serializer 21 provides the video data 14 to the hardware cursor processor 20. The memory controller 42 also retrieves the cursor data 16 from the memory 44 and provides the data 16 to the hardware cursor processor 20. The hardware cursor processor 20 provides parallel composite video data 11 to a random access memory/digital-to-analog converter (RAMDAC) 21. The RAMDAC 21 may be, for example, a model INMOS 176 manufactured by INMOS. The RAMDAC 21 has a memory 21-1 and a digital-to-analog converter (DAC) 21-2. The RAMDAC 21 receives the composite video data 11 from the hardware cursor processor 20 and converts the data 11 into an analog composite signal 19 that is serially representative of the video data and the cursor data. The RAMDAC 21 provides the analog composite signal 29 to the monitor 28 for displaying the video data and the cursor data.

The cursor data 16 is arranged as a serial transmission of K pixels per line of the cursor. Although the cursor is two-dimensional, the invention is described for processing one line of the cursor and video. The two-dimensional cursor is created by performing the process of the invention on multiple lines. The video data 14 is arranged as a concurrent transmission of a plurality of logical pixels 24. The composite video data 11 is arranged as a plurality of concurrent logical pixels 24.

The hardware cursor processor 20 transforms the serial cursor data 16 and combines the transformed cursor data with the parallel video data 14 to generate the parallel composite video data 11. The cursor data 16 includes control commands that indicate the transformation to be performed on the video data to produce the cursor. Such transformations may be, for example, normal video, inverse video (a bit-by-bit inversion of the normal video color), or one of a plurality of cursor colors. As described later herein, the registers 43 provide cursor data to the hardware cursor processor 20.

A CRT controller 17 provides to the hardware cursor processor 20 a display enable signal to indicate when horizontal and vertical non-display times occur, and conversely, when video is to be actively displayed. The CRT controller 17 provides to the hardware cursor processor 20 a vertical cursor enable signal to indicate the scan lines on which the cursor is to be displayed. The CRT controller 17 provides video monitor timing signals to the monitor 28.

Figure 4:
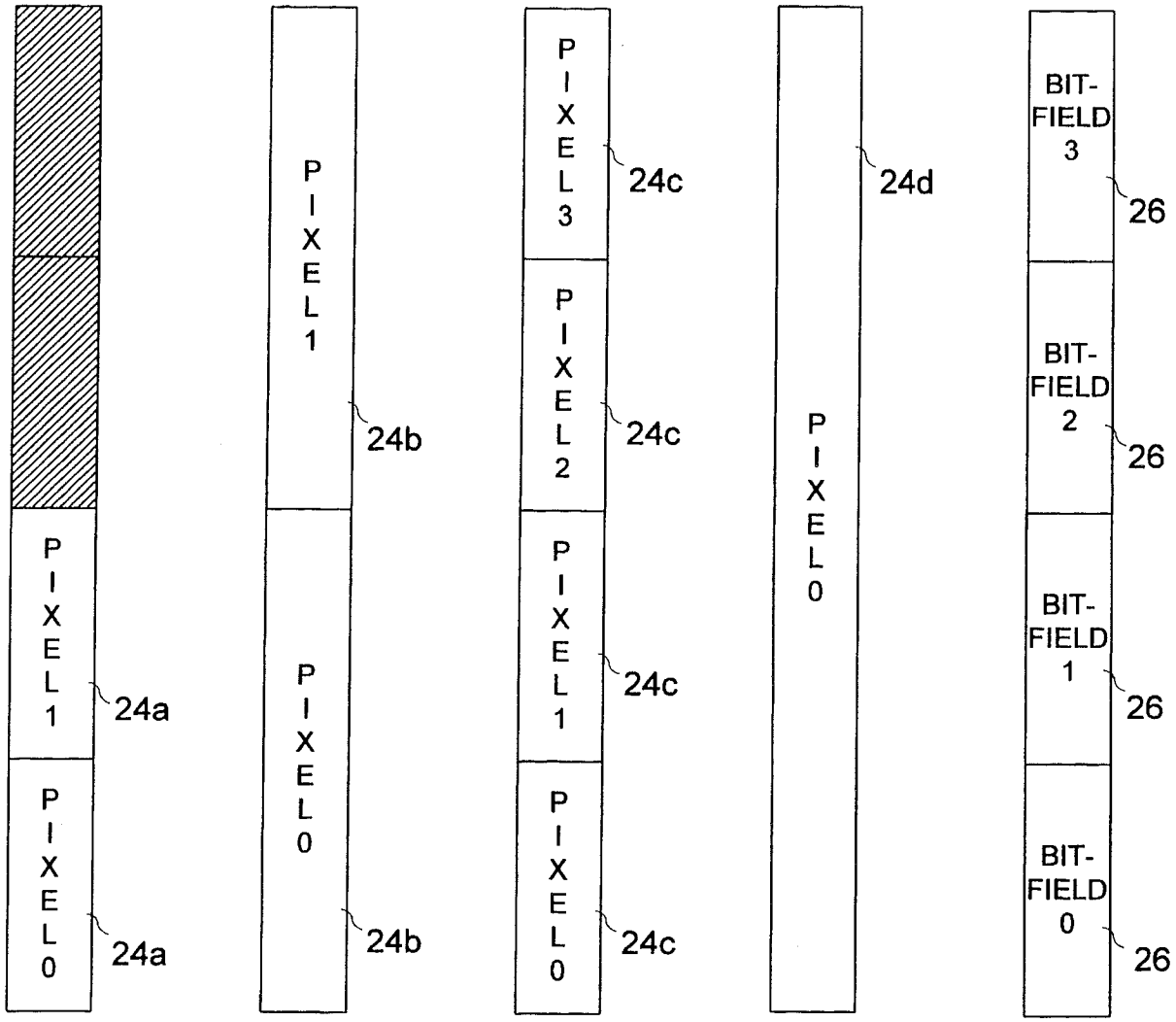
FIG. 4 is a schematic diagram illustrating logical pixels and bitfields of the hardware cursor system of FIG. 3.

Referring to FIG. 4, there is shown a schematic diagram illustrating logical pixels 24 and bitfields 26. The video data 14 has N logical pixels 24. The value of N is preferably a power of 2. Each logical pixel 24 has M bits. For exemplary purposes in the description below, the video data 14 may be formed from any combination of N logical pixels having M bits each where M and N are both powers of 2 and satisfy the equation $M \times N \leqq$ video bus width (width in bits of the parallel composite video data). For example, for a 32-bit parallel video output stream, the number of logical pixels N and the number of bits M per pixel are each selected from the set of {1, 2, 4, 8, 16, 32} such that $N \times M \leqq 32$. Logical pixels of other widths may be supported by disregarding some of the upper bits of the logical pixels. For example, a 24-bit pixel may be represented as a 32-bit pixel by disregarding the upper 8 bits.

Referring in particular to FIG. 4, for a 32-bit video stream, each bitfield 26 has 8 consecutive bits. In a first example, the video data 14 has 2 logical pixels 24*a* of 1 bitfield 26 each. The upper 16 bits are not used. In a second example, the video data 14 has 2 logical pixels 24*b* of 2 bitfields 26 each. In a third example, the video data 14 has 4 logical pixels 24*c* of 1 bitfield 26 each. In a fourth example, the video data 14 has 1 logical pixel 24*d* of 4 bitfields 26.

Figure 5:
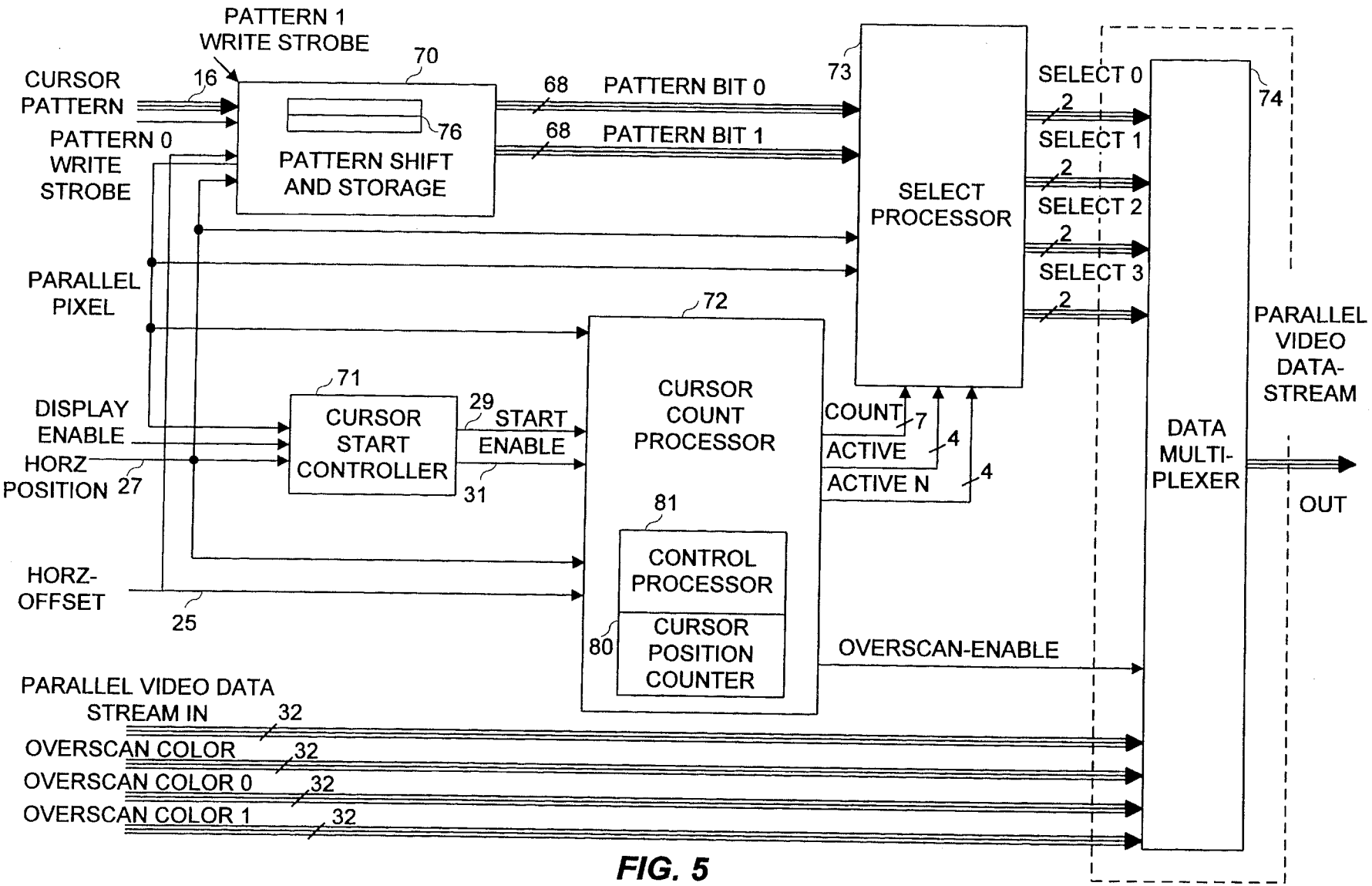
FIG. 5 is a block diagram illustrating a hardware cursor processor of the display system of FIG. 3.

Referring to FIG. 5, there is shown a block diagram illustrating the hardware cursor processor 20 in accordance with one embodiment of the present invention. The hardware cursor processor 20 comprises a pattern shift and storage processor 70 for rotating and storing the cursor data 16. In FIG. 5 and in the other figures, a triple signal line indicates the flow of cursor pattern data, a double signal line indicates the flow of data signals, and a single signal line indicates the flow of control signals. The programmable registers 45 provides; a cursor hotspot signal, a position signal 27, and a preset signal 25 to a cursor start controller 71. Using such signals, the cursor start controller 71 determines the current location of the upper left corner of the cursor pattern.

Figure 6B:
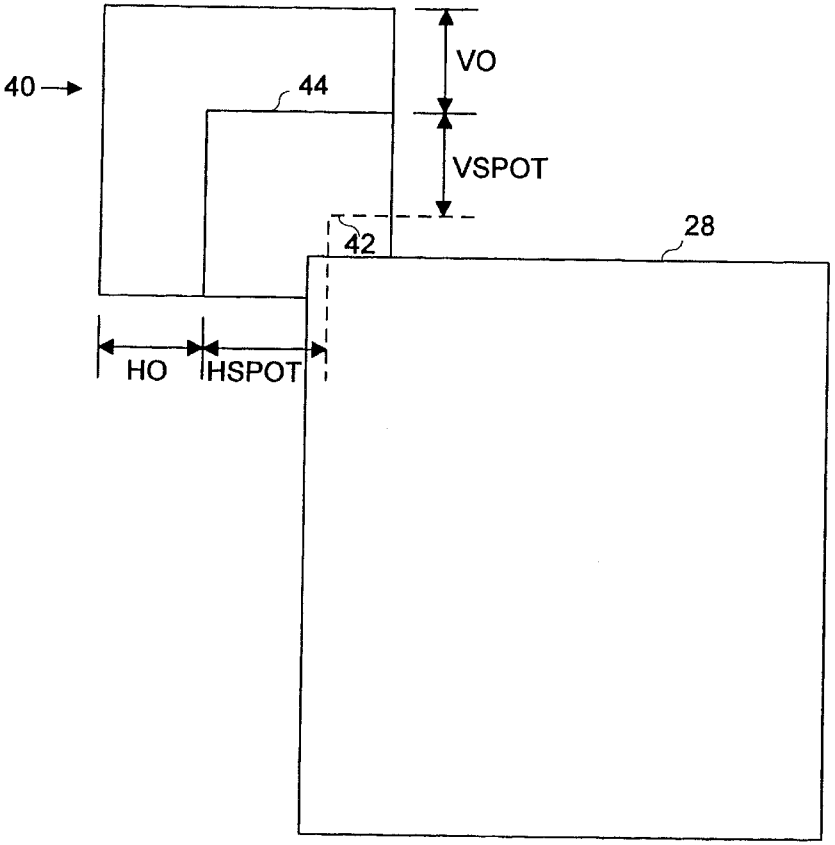
FIGS. 6*a* and 6*b* are schematic views illustrating a cursor in two position on the monitor.
Figure 6A:
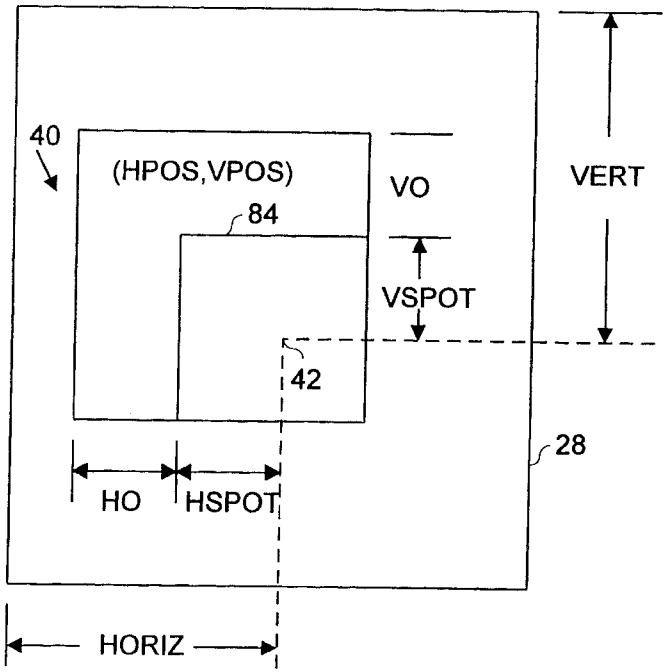

Referring to FIGS. 6*a* and 6*b*, there are shown schematic views illustrating a cursor 40 in two positions on the monitor 28. The cursor 40 has a maximum outline 41. The cursor 40 may be, for example, 32 or 64 scan lines. A portion 44 of the cursor 40 is to be displayed. The upper left corner of the portion 44 is located at position (HPOS, VPOS). Such an upper left corner has a preset (HPRE, VPRE) from the upper left corner of the cursor 40. The horizontal preset HPRE is the index of the cursor pattern used to transform the first displayed pixel of the cursor. A hotspot 42 is overlayed on the monitor 28 to show the active portion of the monitor. The hotspot 42 has an preset (HSPOT, VSPOT) from the upper left corner of the portion 44.

Referring in particular to FIG. 6*a*, the hotspot 42 is displayed within the space defined by the monitor 28. For this case, the upper left corner of the portion 44 is at $$(HPOS, VPOS)=(HPOS-HSPOT, VPOS-VSPOT) \quad (1)$$

and the preset of the upper left corner from the outline is (HPRE, VPRE).

Referring in particular to FIG. 6*b*, the hotspot 42 is outside of the space of the monitor 28. For this case, the upper left corner (HPOS, VPOS) is set to (0,0) and the preset is set to (HPRE−HPOS+HSPOT, VPRE−VPOS+VSPOT).

Referring back to FIG. 5, the cursor start controller 71 provides to a cursor count processor 72 a start signal 29 to indicate the cursor is to be displayed and an enable signal 31 to indicate the end of the cursor pattern. In response to the start signal 29, the cursor count processor 72 provides a count signal indicative of the number of pixels that have been displayed by the cursor to a cursor pattern select processor 73. The cursor count processor 72 provides active enable signals to the cursor pattern select processor 73 to indicate that the cursor is active for each concurrent pixel.

The cursor pattern select processor 73 selects N sets, one for each logical pixel 24, of cursor pattern data from the output of pattern shift and storage processor 70 and generates N sets of bitfield control signals. A data multiplexer 74 receives from the cursor pattern select module 73 the N sets of bitfield control signals and receives from the serializer 21 the video data 14. The data multiplexer 74 transforms the relevant portions of the video data in response to the N bitfield control signals.

The CRT controller 17 generates a vertical cursor enable signal in response to a scan line equal in value to VPOS and continues generating such an enable signal for the number of scan lines of the cursor 40. The CRT controller 17 provides the vertical cursor enable signal to the cursor start controller 71 to activate the controller 71 when the input video signal reaches the VPOS scan line. The calculated horizontal position signal 27 is applied to a respective input of the pattern shift and storage processor 70, the cursor start controller 71, and the cursor count processor 72. The cursor start controller 71 determines the horizontal position at which to start displaying the cursor 40 in response to the calculated horizontal position signal 27. The cursor count processor 72 identifies the control bits of the cursor pattern for the first displayed pixel of the cursor in response to the calculated horizontal position signal 27. The number of bits in the cursor pattern applied to the pattern shift and storage processor 70 equals the number of bits of the maximum cursor width.

The pattern shift and storage processor 70 includes a storage array 76 for storing the cursor pattern. The pattern shift and storage processor 70 receives the cursor pattern input and provides an array of rotated and stored cursor pattern bits to the cursor pattern select module 73. For a 64-bit cursor for example, the cursor pattern has 2 bits per pixel for an aggregate total of 128 bits, and 64 bits are input into the pattern shift and storage processor 70 at one time. The pattern shift and storage processor 70 loads the multiple control bits used for each pixel at different times using control inputs for indicating which control bits are being written. For example, for a cursor pattern having two bits per pixel, the first 64 bits representing bit 0 of the cursor pattern are loaded simultaneously into the storage memory 76 of the pattern shift and storage processor 70 in response to a pattern 0 write strobe from the CRT controller 17. At a time not concurrent with the pattern 0 write strobe, the second 64 bits representing bit 1 of the cursor pattern are similarly loaded simultaneously into a storage memory 76 of the pattern shift and storage processor 70 in response to a pattern 1 write strobe from the CRT controller 17. The write strobes and the transfer of cursor pattern data preferably occur during non-display periods between each displayed horizontal line.

The storage memory 76 has a depth of the number of cursor pattern bits per pixel and a width of the width of the cursor plus (N-1), where N is the number of logical pixels 24 processed per clock. For example, for a 64-bit cursor pattern and a 4 logical pixels 24 per clock (N=4) implementation, the storage memory 76 has a width of 67 bits. The pattern shift and storage processor 70 shifts to the left the input cursor pattern, prior to loading the pattern into the storage memory 76, depending on the horizontal position, the horizontal preset, and the number of logical pixels currently being displayed. The pixel number of the cursor that is to be first displayed is:

$$\text{pixel number}=(\text{Position}=\text{Preset})\text{Modulus number of pixel per clock.} \quad (2)$$

The shift is $$Shift=[HPOS(n{:}0)-HPRE(n{:}0)]\text{modulus } P \quad (3)$$

where (n:0) is the range of bits that specify or select one of the logical pixels per clock, n is the number of bits to describe the maximum number of concurrent P logical pixels, and P is the current number of logical pixels. In a specific implementation for the current number of logical pixels (P) equaling a power of 2, the shift defined by equation (3) becomes $$Shift=[HPOS(Pbits{:}0)-HPRE(Pbits{:}0)]\text{AND maximum shift} \quad (4)$$

where (Pbits:0) is the range of bits that specify or select one of the logical pixels per clock and $$Maximum\ Shift = Number\ of\ current\ logical\ pixels - 1 \quad (4)$$

The shift defined by equation (3) reduces to $$Shift = [HPOS(Pbits{:}0) - HPRE(Pbits{:}0)]\ AND\ (P-1) \quad (6)$$

$$Pbits = log_2(P_{max}) - 1 \quad (7)$$

where P is the current number of logical pixels per clock, $P_{max}$ is the maximum number of logical pixels per clock, if more than one value of P is supported, and (Pbits:0) is the range of bits that specify or select one of the logical pixels per clock.

The pattern shift and storage processor 70 stores in the unused locations in the cursor memory a cursor pattern to indicate that normal video is to be displayed. For example, in unused locations in a conventional VGA AND/OR cursor standard, a '1' is written into pattern bit 1 or a '0' is written into pattern bit 0.

Figure 7:
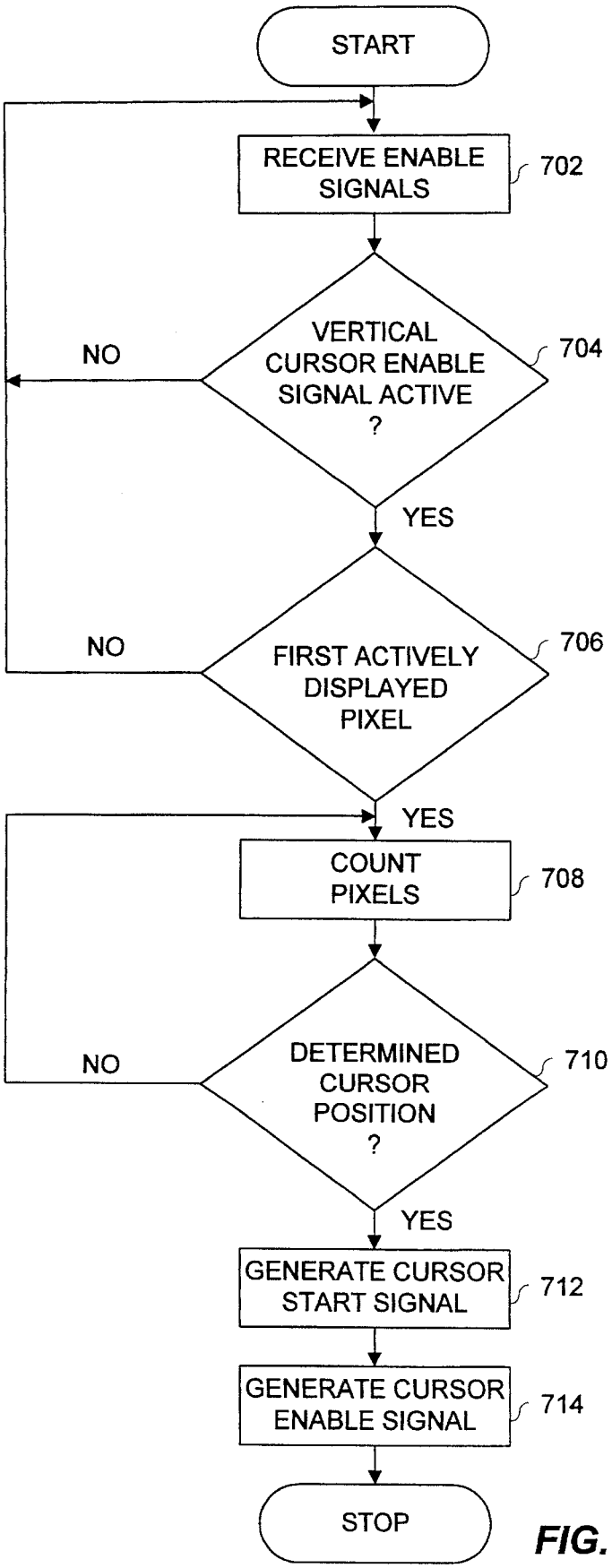
FIG. 7 is a flowchart illustrating the operation of the cursor start controller of FIG. 3.

Referring to FIG. 7, there is shown a flowchart illustrating the operation of the cursor start controller 71. The cursor start controller 71 receives 702 the display enable signal and the vertical cursor enable signal from the CRT controller 17 to indicate the current position of the video stream in relation to the boundaries of the monitor 28. If the vertical cursor enable signal from the CRT controller 17 is active 704, the cursor start controller 71 monitors 706 a display enable signal from the CRT controller 17 for the first actively displayed pixel. In response to the first actively displayed pixel, the cursor start processor 71 counts 708 the number of pixels from the first actively displayed pixel. Upon the match 710 between such a count and the determined horizontal position of the cursor 40 as calculated above in equation (1), the cursor start controller 71 generates 712 a cursor start signal, which is active for one clock. The cursor start controller 71 generates 714 a cursor enable signal in response to the pixel count equaling the calculated horizontal position and the display enable input being active. At the end of each scan line, the CRT controller 17 returns the display enable signal to an inactive state.

The cursor count processor 72 receives the cursor start signal and the cursor enable signal from the cursor start controller 71 and the horizontal preset (HPRE) signal from the programmable register. A cursor position counter 80 of the cursor count processor 72 generates a current position count signal indicative of which cursor pattern bits of the output array of the pattern shift and storage processor 70 are being used for each displayed pixel that the cursor is active. The cursor position counter 80 is loaded with an initial value for the next scan line after the termination of active display on the previous scan line. The initial value is calculated from the equation:

$$Counter\ Load\ Value = [HPRE - (POS\ modulus\ P) + log2(P)]/P \quad (7)$$

where POS is the calculated horizontal position of the cursor, PRE is the horizontal preset, and P is the number of logical pixels 24 processed per clock.

A control processor 81 of the cursor count processor 72 generates a counter terminate signal for controlling the operation of the cursor position counter 80. The counter terminate signal is active, when the counter equals the value for the last bit of the cursor pattern (e.g. for a cursor pattern of Z bits and positions designated 0, 1, . . . Z−1) when the position and preset are aligned, or the counter equals the value Z when the position and preset are unaligned. The position and the preset are aligned if $$(POS\ mod\ P) = (HPRE\ mod\ P) \quad (9)$$

The cursor count processor 72 generates a one-dimensional array of Active registered signals having P entries to indicate which bitfields 26 have the cursor actively displayed and which bitfields are displaying normal video. The elements of the Active signals are set according to Table I. A value of zero (or inactive) indicates normal video is to be displayed. A value of 1 (or active) indicates the cursor is to be displayed; a value of X indicates a "don't care" state (either 0 or 1).

TABLE I

| START SIGNAL | ENABLE SIGNAL | TERMINATE SIGNAL | ELEMENTS OF ACTIVE SIGNAL |
|---|---|---|---|
| Inactive | Inactive | Inactive | Default value (0) |
| Inactive | Active | X | 1 on second to last pixel of displayed cursor |
| Active | X | X | first (POS mod P) elements: 0 remainder: 1 |

The cursor pattern select processor 73 has a first input coupled to the pattern rotation and storage processor 70 for receiving the array of rotated and stored cursor pattern bits. Second and third inputs of the cursor pattern select processor 73 are coupled to the cursor count processor 72 for receiving a cursor count signal and the Active array, respectively. For each P (the number of logical pixels 24 processed per clock), the pattern shift and storage processor 70 divides the cursor pattern output into P equal length arrays and stores the arrays in the memory 76. Each array has a bit width that is equal to the number of bits in the cursor pattern width (e.g., two bits per pixel) and has a length of $$\begin{aligned} length &= (HMAX/P) + 1 && \text{for } P>1 \\ &= HMAX && \text{for } P=1 \end{aligned} \quad (10)$$

where HMAX is the maximum horizontal dimension of the cursor. Each array has every $p^{th}$ element of the cursor pattern output. For example, for P=4, array 0 has elements PATTERN [N×4]; array 1 has elements PATTERN [N×4+1]; array 2 has elements PATTERN [N×4+2]; and array 3 has elements PATTERN [N×4+3]. An implementation concurrently supporting 1, 2, and 4 logical pixels 24 per clock (P) has four 17×2 arrays [P40, P41, P42, P43] for four logical pixels 24 per clock, which can be reorganized logically as two 33×2 arrays [P20, P21] for two logical pixels 24 per clock, or one 64×2 array [P10] for one logical pixel 24 per clock.

The cursor pattern select processor 73 selects one set of cursor pattern bits from each of the arrays in response to the lower bits of the cursor position count signal from the cursor count processor 72 to generate P possible cursor pattern candidates for each value of supported P. For the above example of supporting P=1, 2, and 4, there are four candidates for four logical pixel 24 per clock, two candidates for two logical pixel 24 per clock, and one candidate for one logical pixel 24 per clock. The number of lower order bits used from the cursor position count signal for selecting one element of the array equals $\log_2$ (P) rounded up to an integer. For the above example, the 64-bit wide array P10 and the 33-bit arrays P20 & P21 require the lower six bits of the cursor position count signal to select a single cursor pattern, and the 17-bit array P40–P43 require the lower five bits of the cursor position count signal.

The cursor pattern select processor 73 modifies the selected cursor pattern bits by the Active array generated by the cursor count processor 72 to force the cursor pattern bits to the cursor pattern corresponding to normal video if the corresponding element of the Active array equals "0". For the example described above, when element 0 of the Active array equals 1, the selected cursor patterns from arrays P40, P20, and P10 are passed through without modification;: when element 0 of the Active array equals 0, the selected cursor patterns from arrays P40, P20, and P10 are forced to the normal video pattern. When element 1 of the Active array equals 1, the selected cursor patterns from arrays P41 and P21 are passed through without modification; when element 1 of the Active array equals 0, the selected cursor patterns from arrays P41 and P21 are forced to the normal video pattern. When element 2 of the Active array equals 1, the selected cursor pattern from arrays P42 is passed through without modification; when element 2 of the Active array equals 1, the cursor patterns from arrays P42 is forced to the normal video pattern. When element 3 of the Active array equals 1, the selected cursor pattern from arrays P43 is passed through without modification; when element 3 of the Active array equals 1, the selected cursor pat:tern from arrays P43 is forced to normal video pattern.

The cursor pattern select processor 73 selects one set of cursor pattern bits for each bitfield in the video output stream by selecting a control source for each bitfield depending on P, the number of logical pixels 24 and the width of the pixels. For P equals 1, all bitfield control pattern bits are driven by the selected cursor pattern from array P10. For P equals 2, a 32-bit video output stream supports either two 8-bit pixels or two 16-bit pixels. For two 8-bit pixels, with field control 0 (for video output stream [7:0]) is controlled by the selected cursor pattern from array P20 and bitfield control 1 (for video output stream [15:0]) is controlled by the selected cursor pattern from array P21; bitfield control 2 and 3 (for video output stream 23:16 and 31:24, respectively) are driven with the cursor pattern value for normal video. For two 16-bit pixels, bitfield control 0 and 1 (for video output stream [7:0] and [15:8], respectively) are controlled by the selected cursor pattern from array P20 and bitfield control 2 and 3 (for video output stream [23:16] and [31:24]) are controlled by the selected cursor pattern from array P21. For 8-bit pixels, bitfield control 0 (for video output stream [7:0]) is controlled by the selected cursor pattern from array P40, bitfield control 1 (for video output stream [15:8]) is controlled by the selected cursor pattern from array P41, bit control 2 (for video output stream [23:16]) is controlled by the selected cursor pattern from array P42 and bitfield control 3 (for video output stream [31:24]) is controlled by the selected cursor pattern from array P43. The bitfield control outputs, equal in number to the number of bitfields and equal in width to the width of the cursor pattern input, are typically registered at the output of the cursor pattern select processor 73.

The cursor pattern select processor 73 provides the bitfield control inputs to the data multiplexer 74. The data multiplexer 74 selects the video source independently for each bitfield in response to the bitfield control inputs. Each bitfield in the data multiplexer 74 receives a unique control stream that allows the selection of control functions of the input video stream, control bit stream, and a number of programmable cursor colors. The control stream preferably has a number of bits equal to the number of bits in the cursor pattern. Table II shows the mapping of control bits to the control function for one implementation.

TABLE II

| Control Bits | Video Output Function |
|---|---|
| 00 | Color 0 |
| 01 | Color 1 |
| 10 | Normal Video |
| 11 | Inverse Video |

It should be noted that at least one selection of the control bits maps into normal video to allow the data multiplexer 74 to receive the same size bit field control signal independent of the preset.

Figure 8:
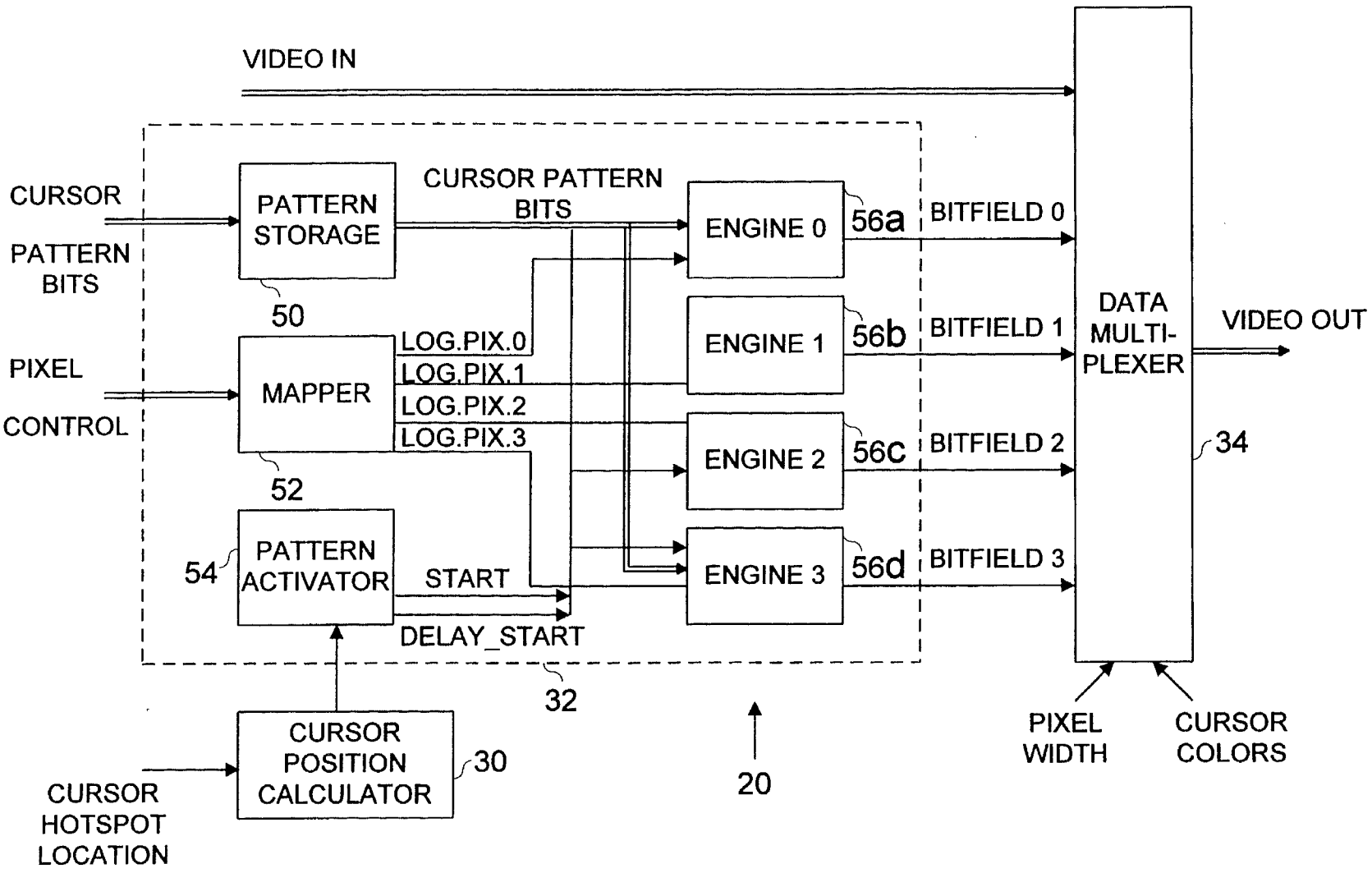
FIG. 8 is a block diagram illustrating a hardware cursor processor according to another embodiment of the present invention.
Figure 11:
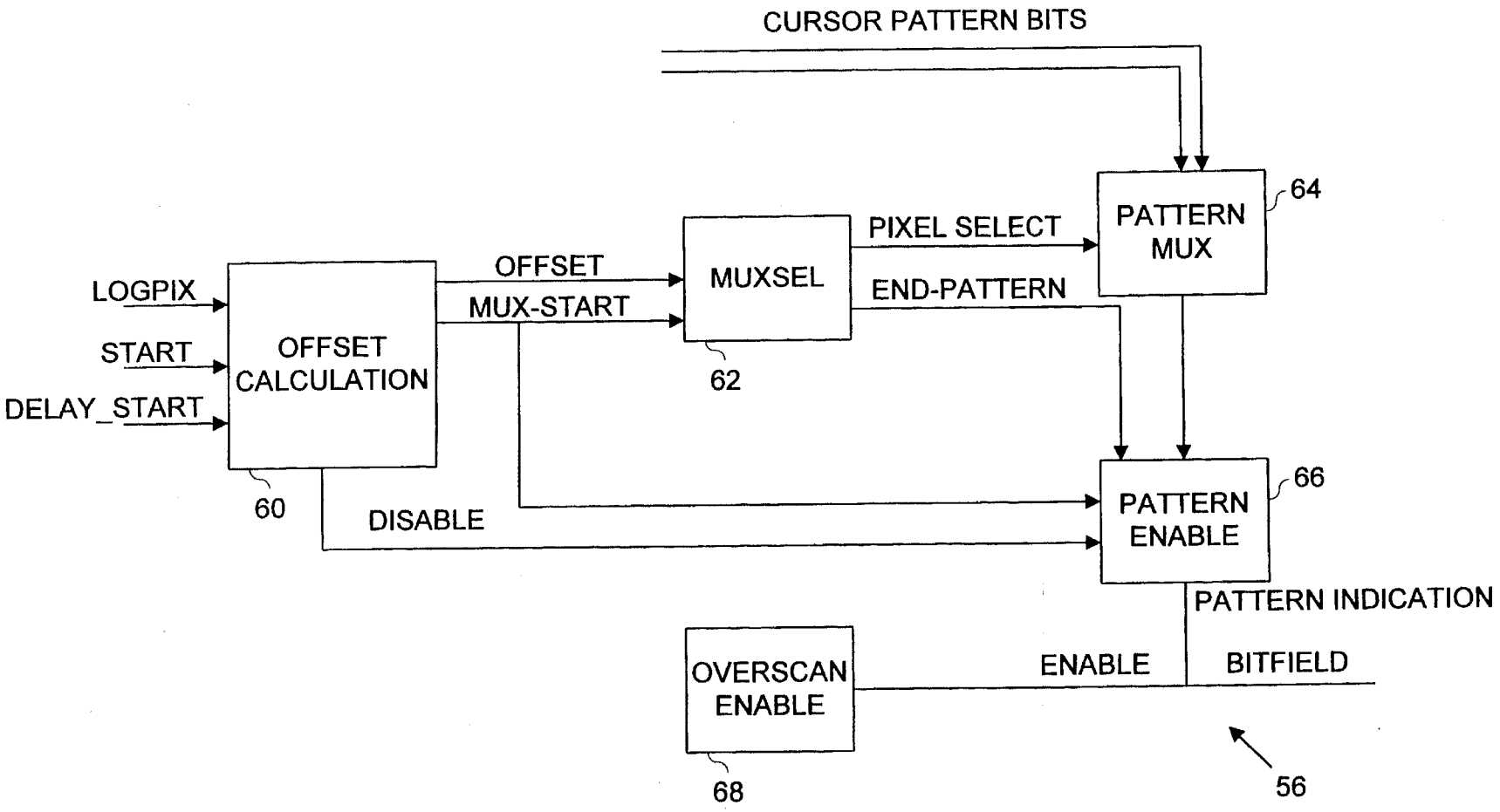
FIG. 11 is a block diagram illustrating an engine of the hardware cursor processor of FIG. 8.

Referring to FIG. 8, there is shown a block diagram of the hardware cursor processor 20 in accordance with another embodiment of the present invention.

The hardware cursor processor 20 includes a cursor position calculator 30, a cursor control unit 32, and a data multiplexer 34.

The cursor position calculator 30 determines the current location of the upper left corner of the cursor pattern from the cursor hotspot, position, and offset information. The cursor control unit 32 utilizes the cursor location information and the cursor pattern 16 to produce concurrent control signals for each bitfield. In accordance with the present invention, the cursor control unit 32 calculates the status of each bitfield 26 based on the logical pixel 24 to which it belongs. The data multiplexer module 34 receives the input video signal and transforms the relevant portions thereof in accordance with the concurrent bitfield control signals.

When the input video signal reaches the VPOS scan line, the cursor control unit 32 is activated.

The cursor control unit 32 typically comprises a pattern storage unit 50, a mapper 52 for mapping logical pixels 24 to bitfields 26, and a pattern activator 54 for indicating when the cursor portion 44 is to be displayed.

The cursor control unit 32 also comprises a plurality of bitfield transformation engines 56, operating in parallel, for determining the cursor status of each bitfield 26 (i.e., which cursor pattern operation is performed on each bitfield) present on a given clock cycle. For example, if there are two 16 bit-logical pixels 24 per clock cycle (e.g., two bitfields 26 per logical pixel 24), two engines 56 determine the status of each logical pixel 24.

In the example shown herein, the cursor processor 20 has four engines 56 in order to operate with data buses capable of handling four concurrent pixels with any number of bits. Additional engines 56 can be added, with changes only to the mapper module 52 and the data multiplier module 31, as the number of simultaneous transformable pixels increases.

For each clock cycle, the cursor control unit 32 determines what each bitfield should display (cursor pattern or video signal) and, if they should display the cursor pattern, which bits of the cursor pattern should be displayed.

The operation of the cursor control unit 32 is illustrated in more detail with reference to FIGS. 9A, 9B, 10A and 10B. Referring to FIGS. 9A and 9B, there is illustrated a portion of a video signal, having logical pixels P0–P12, and a cursor pattern, having cursor pattern pixels C0–C5. It is noted that the examples of FIGS. 9A and 9B have different widths W and numbers N of logical pixels.

In FIG. 9A, the video signal is provided in groups of four logical pixels of eight bits each (i.e., one bitfield per pixel). In FIG. 9B, the video signal is provided in groups of two logical pixels of 16 bits each (i.e., two bitfields per pixel). The pixels processed during one clock cycle are indicated by dotted lines. It can be seen that, for both examples, the six cursor pixels, C0–C5, are to replace logical pixels P3–P8.

FIGS. 10A and 10B correspond to FIGS. 9A and 9B, respectively, and illustrate the output cursor control signal indication of each engine 56 during each of the clock cycles.

In FIG. 10A, it is seen that for the example of FIG. 9A, on the first clock cycle t1, three of the engines 56 indicate that the video signal should not be disturbed. The fourth engine 56d indicates that cursor pattern bit C0 should replace video pixel P3. On the next clock cycle, t2, the engines 56 indicate that cursor pattern bits C1–C4 should replace video pixels P4–P7. On the last clock cycle, t3, only engine 56*a* indicates replacement of video pixels.

FIG. 10B indicates that in the example of FIG. 9B, it takes four clock cycles, T2 –T5, to present the cursor pattern. On the first clock cycle, T1, all engines 56 indicate that the video signal should be preserved. On the second clock cycle, T2, engines 56*a* and 56*b* indicate that the video signal should not be disturbed. However, engines 56*c* and 56*d* indicate that cursor pattern bit C0 should replace video pixel P3. Both engines 56*c* and 56*d* are utilized since video pixel P3 has two bitfields. The third, fourth, and fifth clock cycles T3, T4, T5 are similar.

Referring back to FIG. 8, the pattern activator 54 determines the clock cycle within each scan line (or row of the monitor 28) in which the cursor pattern begins. Also in accordance with the present invention, the engines 56 determine which pixel of the cursor pattern is mapped to which bitfield. The mapper 52 provides the mapping information, and the storage unit 50 provides the cursor pattern for the current scan line.

The pattern storage unit 50 receives the cursor pattern pixels and converts them to an internal format. If necessary, it converts a cursor pattern in the VGA AND/OR format to one in the default, extended graphics adapter (XGA) format. The storage unit 50 typically holds only one row of the pattern, where each row is typically 32 or 64 bits long and each pattern pixel is two bits wide. Such conversion may be, for example, implemented using conventional logic gates, such as AND, OR and INVERT. As is known in the art, the cursor pattern pixels are control indicators indicating the desired operation (normal video, inverse video or a selected color) to be performed to create the cursor pixel on the monitor.

The mapper 52 generates a logical pixel number for each of the four engines 56, where a logical pixel number indicates which logical pixel is associated with each engine 56. The mapping is illustrated in Table III:

TABLE III

Logical Pixel Assignment Numbers
PIXEL ENGINE
LOGICAL PIXEL ASSIGNMENT

| Pixels Per Clock | Pixel Width | Engine 0 | Engine 1 | Engine 2 | Engine 3 |
|---|---|---|---|---|---|
| 1 pixel per clock | | 0 | 0 | 0 | 0 |
| 1 pixel per 2 or 3 clocks | | 0 | 0 | 00 | 00 |
| 2 pixels per clock | 4 or 8 bits per pixel | 00 | 01 | xx | xx |
| 2 pixels per clock | 16 bits per pixel | 00 | 00 | 01 | 01 |
| 2 pixels per clock | 32 bits per pixel | illegal | | | |
| 4 pixels per clock | 4 or 8 bits per pixel | 00 | 01 | 10 | 11 |
| 4 pixels per clock | 16 or 32 bits per pixel | illegal | | | |

As the examples of FIGS. 9 and 10 indicate, the initial cursor clock cycle (the clock cycle on which the cursor pattern begins) is dependent on the number N of logical pixels per clock cycle, as well as on the desired logical pixel location of the cursor. Furthermore, the first clock cycle typically has some logical pixels which are to display the video signal and some which are to display the cursor pattern. The pattern activator 54 determines the initial cursor clock cycle, START, and the engines 56 determine which logical pixels of the initial cursor clock cycle are to display the cursor pattern.

The desired information is provided by the relationship between the horizontal position of the cursor HPOS and the number N of logical pixels per clock cycle, HPOS/N. The integer value of HPOS/N is the initial cursor clock cycle, START, or $$\text{START}=\text{INT}(\text{HPOS/N}) \tag{11}$$

The remainder of HPOS/N points to the logical pixel number (i=0 . . . 3) of the initial cursor clock cycle at which the cursor pattern begins.

Thus, for the example of FIGS. 9A and 10A, HPOS=3, N=4, int (HPOS/N)–0 and rem(HPOS/N)=3. The initial cursor clock cycle is then t0 and the first logical pixel to receive the cursor pattern is i=3, implemented by engine 56*d*.

For the example of FIGS. 9B and 10B, HPOS=3, N=2, int(HPOS/N)=1 and rem(HPOS/N)–1. The initial cursor clock cycle is then T1 and the first logical pixel to receive the cursor pattern is i=1, implemented by engines 56*c* and 56*d*.

To determine whether or not a logical pixel receives the cursor pattern, an adjusted offset, determined by the following formula, is used:

$$\text{adjusted offset}=\text{logical pixel number}-\text{remainder} \tag{12}$$

If adjusted offset is greater than or equal to 0, the logical pixel receives part of the cursor pattern. Otherwise, the logical pixel begins to receive the cursor pattern on the next clock cycle, indicated by the signal DELAY_START.

The absolute value of the adjusted offset points to the first logical pixel of the cursor pattern which the particular engine 56 is to process. Thus, the engine 56*c* has an offset of 3 in the example of FIG. 10A and an offset of 0 in the example of FIG. 10B. The adjusted offset can be considered the "phase" shift of the engine 56 vis-à-vis the first cursor pixel.

When the clock cycle equals START, the pattern activator 54 synchronously generates the START signal and maintains it that way until the end of the scan line. The DELAY_START signal is synchronously generated at the next clock cycle.

Reference is now made to FIG. 9 which illustrates the elements of each engine 56. The engine 56 typically comprises an offset calculation unit 60, a multiplexer selector (MUXSEL) 62, a pattern multiplexer (MUX) 64, a pattern enable unit 66, and an overscan enable unit 68.

When each engine 56 receives the START signal, the pattern calculation unit 60 processes equation (11) determine 1) whether it is to provide a video or cursor pattern signal on the initial cursor clock cycle and 2) its phase shift from the beginning of the cursor pattern. If the pattern calculation unit 60 it to begin providing cursor pattern signals on the present clock cycle, a MUXSTART signal is produced and maintained until the end of the scan line.

The logical pixel number (LOGPIX(0–3)) associated with the engine 56 is provided from the mapper 52. It is noted that when a logical pixel is formed of more than one bitfield, the mapper 52 provides the same logical pixel number to more than one engine 56. The adjusted offset and MUXSTART signals are provided to the multiplexer selector 62 which is operative to determine the cursor pattern logical pixel to be displayed for a given clock cycle. The multiplexer selector 62 includes a counter which begins counting when the MUXSTART signal is received and on each clock cycle, increases by the number of concurrent logical pixels per clock cycle. The counter value is added to the adjusted offset to determine the logical pixel of the cursor pattern to be displayed on the given clock cycle. The resultant PIXEL SELECT value is provided to the pattern multiplexer 64.

When the counter of the multiplexer selector 62 exceed the maximum width of the cursor (typically 31 or 63 logical pixels), the selector 62 produced an END_PATTERN signal indicating that no further cursor indications should be provided.

The pattern multiplexer 64 receives the PIXEL SELECT value and selects the corresponding cursor pattern bits from the cursor pattern data stream. Each logical pixel of the cursor pattern contains two bits and indicates one of the following: a first cursor color, a second cursor color, normal video or inverse video.

The pattern enable unit 66 provides the two cursor pattern bits unless it has received a disable or an END_PATTERN signal. A disable signal is typically provided if the particular engine 56 is not to be utilized, such as happens when the displayed cursor is narrower than the number of concurrent pixels. When a disable or the END_PATTERN signal is received, the pattern enable unit 66 forces the pattern stream to provide a normal video signal.

The data multiplexer module 34 receives the BITFIELDi signals, the input video signal, the pixel width and the cursor colors from the programmable register 43 and outputs a video signal having therein cursor data. The video signal is a parallel, typically 32 bit, signal, of the same width as the video input stream.

The data multiplexer module 34 may perform the following operations:

1) selects between color map standards;

2) conditions the two cursor colors to have the appropriate pixel width;

3) for each bitfield of the incoming video signal, independently selects one of the following signals based on the value of the relevant BITFIELDi signals; first cursor color, second cursor color, normal video, inverse video or overscan color; and 4) provides the output video signal as a parallel signal of the selected size (i.e., two 8-bit pixels, one 16-bit pixel, one 32-bit pixel, etc.).

It is noted that the present invention is extendible and can process, in parallel, any desired number of logical pixels that are a power of two. Furthermore, the hardware cursor provides a parallel video signal as output.

In addition, the present invention can be applied to any number of pixel bus width, pixel depths and concurrent pixel counts that are a power of 2. The invention supports cursors of different sizes by varying the size of the cursor pattern storage, the pattern select counters of the selector 62, the cursor terminate comparators of the selector 62 and the pattern multiplexers.

I claim:

1. A method for storing in a cursor display array a cursor for display on a screen having a plurality of pixels, the cursor display array having a plurality of storage elements, the method comprising the steps of:

receiving a series of clock signals;

receiving concurrently and in parallel a number P pixels of the cursor responsive to one of the series of clock signals;

receiving a cursor position signal indicative of a position on the screen where the cursor is to be displayed;

receiving a preset signal indicative of the first pixel of the cursor that is to be displayed;

calculating the number of the first pixel within the number P concurrent pixels of the cursor that is to be displayed responsive to the cursor position signal and the preset signal;

storing the cursor in the cursor display array starting at one of the plurality of storage elements of the cursor display array corresponding to the calculated number of the pixel;

providing codes indicative of picture data;

storing the codes indicative of picture data in ones of the plurality of storage elements having no cursor data stored therein;

receiving concurrently and in parallel the number P pixels of video data responsive to one of the series of clock signals;

receiving a video position signal indicative of a position on the screen where the video data is to be displayed;

comparing the video position signal to the cursor position signal;

generating an indicator having a first logic state if the cursor position signal matches the video position signal and having a second logic state if the cursor position signal does not match the video position signal;

providing in parallel the number P pixels of video data responsive to one of the series of clock signals if the indicator has a second logic state;

retrieving the cursor if the indicator has a first logic state;

providing the pixel of the cursor if the corresponding one of the plurality of storage elements has cursor data stored therein; and if the one storage element has a code indicative of picture data stored therein, providing the pixel of the video data corresponding to the one storage element.

2. The method of claim 1 wherein the step of calculating the number of the first pixel includes the step of calculating the pixel number using the equation

*pixel number=(Position−Preset) modulus (number of pixels per clock).*

* * * * *